US005226712A

United States Patent [19]

Lucas

[11] Patent Number: 5,226,712

[45] Date of Patent: Jul. 13, 1993

[54] HANDS-FREE FLASHLIGHT HELD BETWEEN TEETH

[76] Inventor: Richard G. Lucas, 4301 S.W. 31st Dr., Hollywood, Fla. 33023

[21] Appl. No.: 981,782

[22] Filed: Nov. 25, 1992

[51] Int. Cl.[5] ..... F21L 15/08

[52] U.S. Cl. ..... 362/103; 362/108; 362/190; 362/206

[58] Field of Search ..... 362/103, 108, 158, 157, 362/190, 191, 200, 206

[56] References Cited

U.S. PATENT DOCUMENTS

| | | | |
|---|---|---|---|
| 2,244,288 | 6/1941 | Colby | 362/191 |
| 2,299,467 | 10/1942 | Colby | 362/190 |
| 3,418,461 | 12/1968 | Sedlock | 362/191 |
| 5,063,483 | 11/1991 | Feilmeier et al. | 362/103 |

*Primary Examiner*—Richard R. Cole
*Attorney, Agent, or Firm*—Malloy & Malloy

[57] ABSTRACT

A flashlight having a main body with a light emitting source at a distal end thereof powered by a battery power source within the main body and a switch at an opposite proximal end encapsulated within a resilient switch jacket defining an oral grasping portion adapted to be held between a user's upper and lower front teeth such that a biting force exerted thereon serves to operate the switch between an open position and a closed position. The proximal end of the main body is sized and configured to prevent accidental, forced entry of the flashlight into the user's oral cavity during use. A neck strap attached at opposite ends to the main body allows the flashlight to be hung about the user's neck in a readily accessible orientation.

7 Claims, 1 Drawing Sheet

HANDS-FREE FLASHLIGHT HELD BETWEEN TEETH

BACKGROUND OF THE INVENTION

1. Field of the Invention

The present invention is directed to a flashlight adapted to be held in the mouth of a user, and specifically by the user's teeth, so that the user can perform various functions requiring the use of two hands when light is needed.

2. Description of the Related Art

Often, the performance of various tedious tasks as encountered in many professions and hobbies requires the use of two hands. A problem occurs during the performance of such tasks when the ambient light conditions require the use of a flashlight or other artificial light source. In such instances, the person performing the task, such as a locksmith working on a light in dark conditions or a person baiting a fish hook at night, is unable to hold a flashlight in a conventional manner without sacrificing the use of one hand. In an attempt to solve this dilemma, many individuals, including locksmiths, plumbers, electricians, fisherman, and the like, commonly hold a conventional-type flashlight in their mouth so as to direct light to the required area, thereby allowing for the use of both hands.

However, a common problem associated with holding a conventional flashlight in one's mouth is the inability to properly hold and control movement of the flashlight so as to properly direct the light emitting therefrom. Further, placement of a conventional flashlight within one's mouth substantially interferes with the ability to properly communicate with others who may be assisting in the performance of the task. This unconventional method of holding a flashlight in one's mouth further interferes with the individual's ability to swallow properly and usually results in excessive drooling which can be uncomfortable and distracting, not to mention messy. Finally, one of the most significant problems associated with holding a conventional-type flashlight in one's mouth is the danger of having the flashlight inadvertently force back through the oral cavity into the upper throat resulting in a painful, and possibly severe injury.

Even in view of the many problems associated with holding a conventional-type flashlight in one's mouth, many individuals, especially locksmiths, continue to practice this method in the absence of a satisfactory solution. Primarily, this is due to the fact that not only does holding a flashlight in one's mouth free up both hands for performing a certain task, but it also provides a direct beam of light along the individual's line of vision, thereby providing optimum lighting conditions.

Accordingly, in view of the problems associated with holding conventional-type flashlights in one's mouth as discussed above, there still exists a need in the present flashlight art for a specifically designed flashlight which is adapted to be held in an individual's mouth in a comfortable, effective manner.

OBJECTS AND ADVANTAGES OF THE PRESENT INVENTION

With the foregoing in mind, it is a primary object of the present invention to provide a flashlight adapted to be held in a user's mouth, and particularly between a user's upper and lower teeth so as to direct a beam of light in a desired direction while enabling the use of both hands to perform a particular task.

It is a further object of the present invention to provide a flashlight adapted to be held between a user's teeth in such a manner so as to not interfere with the user's speech and/or ability to properly communicate.

It is another object of the present invention to provide a flashlight adapted to be held comfortably between a user's teeth in such a manner so as to allow controlled movement of the flashlight and a light beam emitting therefrom.

It is yet a further object of the present invention to provide a flashlight which is adapted to be held comfortably between a user's teeth and which is further structured so as to prevent inadvertent forced entry of the flashlight into the user's oral cavity and upper throat.

It is still a further object of the present invention to provide a flashlight which is adapted to be held between a user's teeth and further including switch means which is structured to be operated between an open and closed position by a biting force exerted by the user's teeth.

It is still another object of the present invention to provide a flashlight which is adapted to be held and operated by a user's teeth and which further includes a neck strap to facilitate hanging of the flashlight about the user's neck so as to be positioned in a readily accessible orientation relative to the user.

These and other objects and advantages of the present invention will be more readily apparent in the description which follows.

SUMMARY OF THE INVENTION

The present invention is directed to a flashlight which is specifically adapted to be held between a user's teeth so as to facilitate use of both hands while directing a beam of light along the user's line of vision. The flashlight includes a main body having a top half and a bottom half joined along a side seam. The main body may be formed of a luminous, glow-in-the dark material to increase visibility of the flashlight at night. An interior of the main body includes a power source compartment for housing batteries or another type of power source, including a rechargeable battery.

A light reflective chamber is mounted within the interior of the main body of the flashlight adjacent a distal end thereof and includes a light reflective concave wall having an open end terminating at the distal end of the main body. A lightbulb is fitted within a bulb socket in the light reflective wall in such a manner so as to direct light outwardly from the distal end of the main body. A lens is removably fitted over the distal end in covering relation to the light reflective chamber and lightbulb therein. The lens may be movably adjusted so as to control the width of a light beam emitted therefrom.

A switch is provided at a proximal end of the main body of the flashlight and is encapsulated within a switch jacket extending from the proximal end and defining an oral grasping portion which is adapted to be held between a user's upper and lower front teeth. Exerting a biting force on the resilient switch jacket serves to operate the switch therein between an open and closed position thereby enabling controlled activation and deactivation of the lightbulb.

The proximal end of the main body is specifically sized and configured to have a width which is substantially greater than the width of an average user's jaw width so as to prevent inadvertent forced entry of the flashlight into the user's oral cavity and upper throat, preventing severe injury thereto.

A neck strap is provided to enable the flashlight to be hung about the user's neck such that the flashlight is readily available when needed. The neck strap is preferably attached at opposite ends to the proximal end of the main body such that the oral grasping portion is oriented upwardly enabling the quick, uninterrupted movement of a flashlight from a hanging position to an operable position between the user's teeth.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
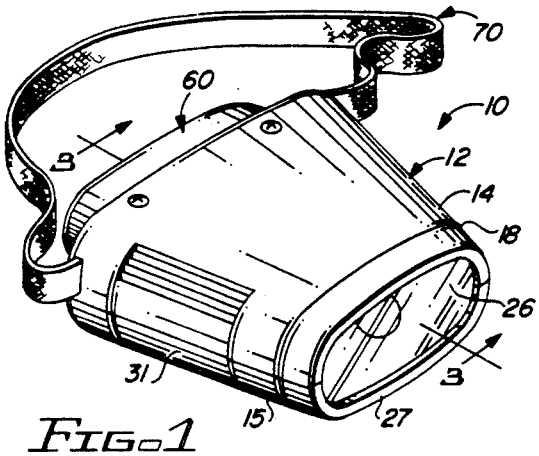
FIG. 1 is a top, front perspective view of a preferred embodiment of the flashlight of the present invention.

With reference initially to FIG. 1, there is shown a preferred embodiment of the flashlight, generally indicated as 10, including a main body 12. The main body 12 includes a top half 14 and a bottom half 15 joined together along seam 16 by conventional assembly screws 17. The main body 12 further includes a distal end 18 and a proximal end 19.

Within an interior of the main body 12, there is a light reflective chamber 20 having a concave light reflective wall 21 mounted therein with an open end adjacent the distal end 18 of the main body. A lightbulb 24 is mounted within a light socket 25 formed in the light reflective wall 21 in the lightbulb chamber 20. A lens frame structure 27 having a lens 26 fitted therein is removably fitted to the distal end 18 of the main body 12, such that the lens extends thereacross in covering relation to the lightbulb chamber 20 in spaced relation from the lightbulb 24.

Figure 2:
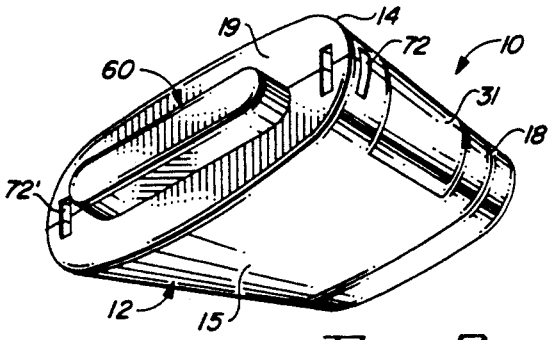
FIG. 2 is a rear, bottom perspective view of the flashlight.
Figure 3A:
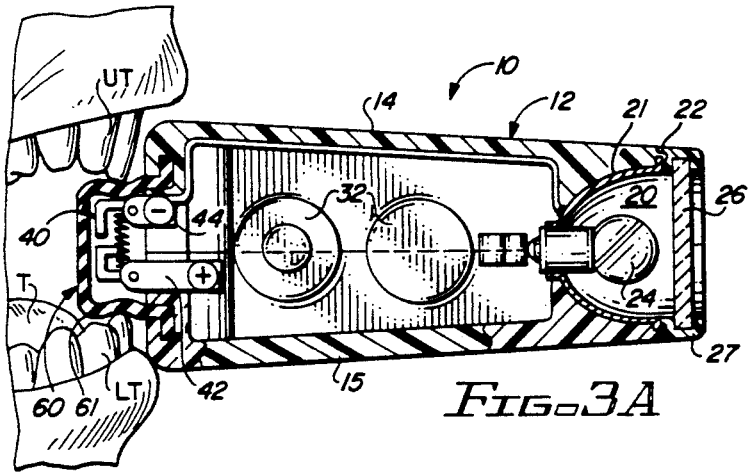
FIG. 3A is a sectional view taken along the line 3—3 of FIG. 1 illustrating the internal components of the flashlight being held in an operable position between a user's teeth.
Figure 4:
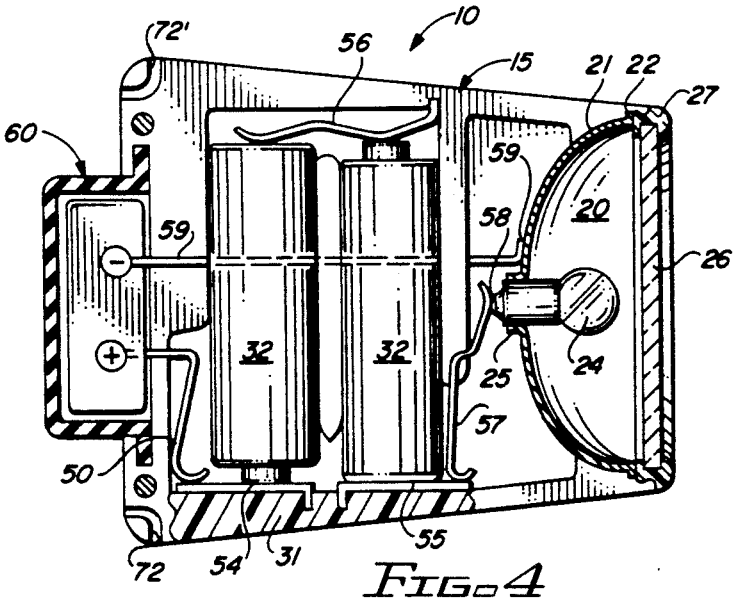
FIG. 4 is a top plan view, in partial section, of a bottom half of the flashlight of the present invention.

As best illustrated in FIGS. 3A and 4, the main body 12 is further provided with a battery chamber 30 having an access cover 31 (see FIGS. 1 and 2) to facilitate access to the battery chamber. The battery chamber 30 is specifically structured so as to contain batteries 32 therein in a manner so as to position the flashlight's center of gravity closer to the proximal end 19.

Figure 3B:
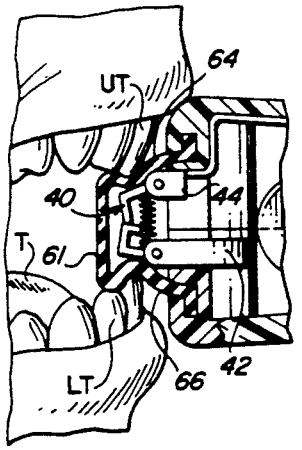
FIG. 3B is an isolated view, shown in section, illustrating operation of a switch of the flashlight by a biting force exerted by the user's teeth.

Referring to FIGS. 3A and 3B, a switch 40 is provided at the proximal end 19 and includes an operable portion which protrudes from the proximal end so as to facilitate operable engagement by upper and lower teeth UT, LT of the user, as described in more detail hereinafter. A positive terminal 42 of the switch 40 is electrically interconnected with a conductive contact wiper 50 attached at one end to the positive terminal 42 and electrically contacting a contact plate 54 in the battery chamber 30, at an opposite end thereof. The contact plate 54 is preferably attached to the access cover 31 such that a positive terminal of one of the batteries 32 is disposed in contact when the cover 31 is positioned in covering relation to the battery chamber 30. A second contact plate 55, also mounted on the inside of the access cover 31, is positioned for contact with a negative terminal of an adjacent one of the batteries 32. On an opposite side of the battery chamber 30, a contact wiper blade 56 extends so as to contact the opposite terminal ends of batteries 32 to complete a flow of electrical current from the switch 40 through the batteries 32. A bulb contact blade 57 electrically engages contact plate 55 at one end and includes a spring biased opposite end which is urged into electrical contact with lightbulb 24 as at 58. A ground contact 59 extends from the negative side of switch 40 to the lightbulb socket 25 to complete the electrical circuit.

The present invention further includes teeth grasping means 60, as best illustrated in FIG. 2, FIG. 3A, and FIG. 3B. The teeth grasping means 60 includes a switch jacket 61 formed of a resilient, durable material such as a rubber compound which is suitable oral contact. The switch jacket 61 has a generally hollow construction and effective encapsulates the switch 40 therein. The switch jacket 61 includes an upper side 64 and a lower side 66 which are adapted to be grasped between the user's upper UT and lower LT front teeth.

The teeth grasping means 60 has a generally elongate configuration extending partially along a length of the proximal end 19 of the main body 12 so as to facilitate engagement with a number of the user's upper and lower teeth thereby increasing the user's ability to stabilize and control the flashlight 10 by simply moving the lower jaw relative to the upper jaw. As seen in FIG. 3A and FIG. 3B, the teeth grasping means 60 is specifically designed so as to avoid invading the oral cavity, thereby preventing interference with the tongue T. In this manner, the user is able to swallow properly and communicate coherently while holding the flashlight 10 in an operative position between the upper and lower teeth, UT and LT.

Operation of switch 40 is achieved by applying a biting force on the upper side 64 and lower side 66 of the switch jacket 61, as illustrated in FIG. 3B. Upon applying a biting force, the switch jacket 61 yields such that the force from biting is exerted on switch 40, causing switch 40 to be operatively moved between an open position and a closed position, thereby controlling current flow to the lightbulb for effective activation and deactivation thereof.

A neck strap 70 is provided, as best seen in FIG. 1, to facilitate hanging of the flashlight 10 about the user's neck such that the flashlight is readily available for insertion of the teeth grasping means between the teeth for operation thereof. The neck strap is preferably attached at opposite ends through strap attachment channels 72, 72' provided on the proximal end 19 of the main body 12 of the flashlight 10.

Now that the invention has been described,

What is claimed is:

1. A flashlight comprising:

a main body including a top half and a bottom half joined along opposite side edges thereof and a distal end, a proximal end, and an interior, a light reflective chamber mounted within said interior of said main body and including an open end positioned adjacent to said distal end of said main body, a light emitting source mounted within said light reflective chamber, said light emitting source and said light reflective chamber being cooperatively structured and disposed to direct a beam of light outwardly from said distal end of said main body, a lens removably fitted on said distal end of said main body in covering relation to said open end of said light reflective chamber, said interior of said main body further including a power source compartment, including an access cover, said power source compartment being structured to receive a power source therein for supplying power to said light emitting source for activation thereof, teeth grasping means attached to and extending outwardly from said proximal end of said main body, said teeth grasping means being structured and configured for grasping thereof between upper and lower front teeth of a user, wherein said flashlight can be held without the use of hands in a manner so as to direct the beam of light in a direction along a line of sight of the user's vision, said teeth grasping means being formed of a resilient, durable, flexible material adapted to withstand pressure exerted thereon by the user's teeth, switch means encapsulated within said teeth grasping means and being structured and disposed for operative movement between an open position and a closed position by a biting force exerted thereon by the user's teeth so as to effectively activate and deactivate said light emitting source, said main body including a width at said proximal end, measured between said opposite sides thereof, being wider than an average jaw width thereby preventing inadvertent, forced entry of said proximal end within the user's oral cavity and upper throat, and a neck strap having opposite distal ends attached to said opposite sides of said main body at said proximal end and being adapted to be draped about the user's neck such that said flashlight hangs in a readily accessible position.

2. A flashlight as recited in claim 1 wherein said main body has a generally oblate configuration wherein an average width measured between opposite sides thereof is substantially greater than an average thickness measured between said top half and said bottom half.

3. A flashlight as recited in claim 2 wherein said width of said main body at said proximal end, measured between said opposite sides thereof, is substantially greater than a width of said main body at said distal end.

4. A flashlight as recited in claim 3 wherein said teeth grasping means includes a substantially elongate, hollow rubber switch jacket attached to and extending along a portion of a length of said proximal end and protruding therefrom.

5. A flashlight as recited in claim 4 wherein said switch jacket includes an upper side and a lower side disposed in covering, surrounding relation to said switch means, said upper side being adapted to receive the user's teeth and said lower side being adapted to receive the user's lower teeth such that said jacket can be effectively held between the user's upper and lower teeth.

6. A flashlight as recited in claim 5 wherein said switch jacket is structured and configured to protrude outwardly away from said proximal end a sufficient distance to allow grasping thereof between the user's teeth without invading the oral cavity, thereby preventing interference with the user's ability to speak coherently.

7. A flashlight as recited in claim 6 wherein at least a portion of said main body is formed of a luminous material.

* * * * *